US005742876A

United States Patent [19]

Bogoshian

[11] Patent Number: 5,742,876

[45] Date of Patent: Apr. 21, 1998

[54] DONOR ROLL CONFIGURATION OF A XEROGRAPHIC DEVELOPMENT UNIT USING MAGNETIC TONER

[75] Inventor: Gregory V. Bogoshian, Rochester, N.Y.

[73] Assignee: Xerox Corporation, Stamford, Conn.

[21] Appl. No.: 808,756

[22] Filed: Mar. 3, 1997

[51] Int. Cl.[6] ..... G03G 15/08

[52] U.S. Cl. ..... 399/104

[58] Field of Search ..... 399/103, 104, 399/106, 276, 279, 265, 267, 273, 283, 286, 289

[56] References Cited

U.S. PATENT DOCUMENTS

| | | | |
|---|---|---|---|
| 4,676,192 | 6/1987 | Yuge et al. | 399/259 |
| 4,774,543 | 9/1988 | Yoshikawa et al. | 399/231 |
| 5,084,733 | 1/1992 | Katoh et al. | 399/104 |
| 5,166,733 | 11/1992 | Eliason . | |
| 5,267,007 | 11/1993 | Watanabe et al. | 399/104 |
| 5,450,169 | 9/1995 | Hart et al. | 399/104 |
| 5,552,864 | 9/1996 | Malicki et al. | 399/104 |
| 5,592,268 | 1/1997 | Uehara et al. | 399/276 |

FOREIGN PATENT DOCUMENTS 6-027796 2/1994 Japan .

*Primary Examiner*—Matthew S. Smith
*Attorney, Agent, or Firm*—R. Hutter

[57] ABSTRACT

In a development unit for electrostatographic printing, where toner particles are conveyed by a rotating roll to a charge-retentive surface, a groove is defined in the interior surface of the housing which retains the toner particles, the groove extending along a portion of the circumference of the roll. The groove facilitates redistribution of toner particles which accumulate at the bottom of the housing near an end of the roll.

17 Claims, 2 Drawing Sheets

FIG. 1
PRIOR ART
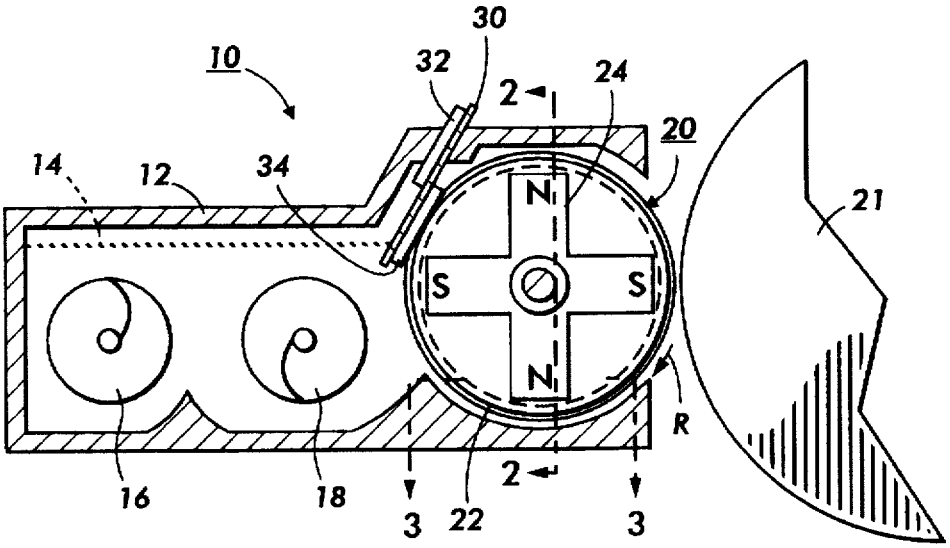
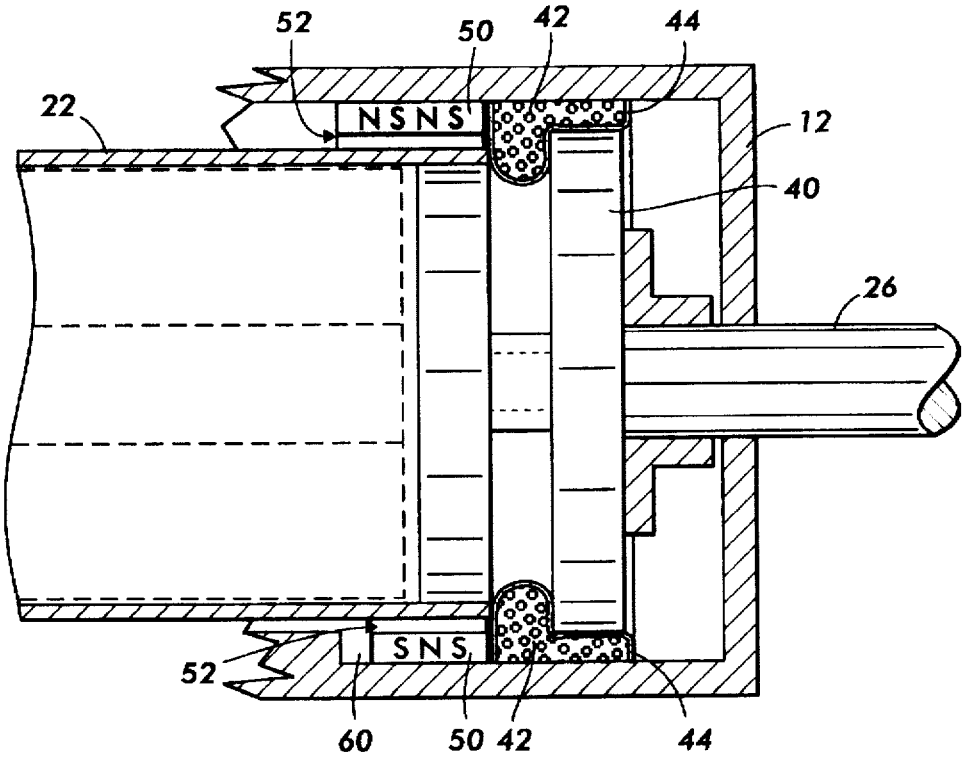
FIG. 2

DONOR ROLL CONFIGURATION OF A XEROGRAPHIC DEVELOPMENT UNIT USING MAGNETIC TONER

FIELD OF THE INVENTION

The present invention relates to xerographic development units which apply magnetic toner to an electrostatic latent image. More specifically, the present invention relates to a housing and donor roll configuration in such a development unit.

BACKGROUND OF THE INVENTION

In the well-known process of xerography, or electrophotographic printing, a charge retentive surface, known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the appropriately-charged areas on the latent image.

A commonly used development technique involves a single-component developer material. In a typical single-component development system, each toner particle has both magnetic properties (to allow the particles to be magnetically conveyed to the photoreceptor) and an electrostatic charge (to enable the particles to adhere to the photoreceptor). In such a system, the development unit includes a donor roll, which is in the form of a cylindrical sleeve which rotates about a stationary magnet assembly. The magnetized toner particles adhere to the rotating sleeve by the force of the stationary magnets within the sleeve.

A charge/metering or C/M blade contacts the toner particles on the sleeve along one longitude of the donor roll. The C/M blade performs two simultaneous functions: it allows a uniform metered layer of toner to pass underneath, and uniformly charges the toner. That is, the action of the toner particles rubbing against the blade and each other while being metered by the blade induces a charge on the toner particles. The uniformity of the nip formed between the blade and the developer roll plays a significant role in creating a uniform charge of toner across the development roll. "Charge sharing" among particles, charge polarity, and charge level are also controlled through the use of charge control additives loosely attached to the surface of the toner particles.

When this thin layer of uniformly-charged particles is obtained, the donor roll advances the toner particles to a development zone adjacent the surface of the photoreceptor.

In the development zone, the toner particles adhering magnetically to the donor roll are attracted electrostatically to the latent image recorded on the photoreceptor. AC and DC biases may be applied to the donor roll to enhance and control this process.

Single-component developers which are comprised mainly of toner particles having magnetic properties are particularly useful in a special segment of the electrophotographic printing market, the creation of magnetic ink character recognition (MICR) documents, where the ink or toner forming the characters has magnetic properties. As is well known, MICR characters such as appear on checks are printed in special fonts by which each character creates a signature pattern of magnetic flux which can be recognized when the characters are run past a magnetic read head. Thus, in a single-component development system, the same magnetic properties which enable the toner to be conveyed around a developer roll are also useful for creating the magnetic properties of the characters on a sheet.

In any type of development unit, a major practical concern is the design of the "roll seal," a sealing structure around the support on which rolls within the development unit are supported. These roll seals are the site of major design concerns, particularly leakage of toner and other material out of the development unit into the rest of the machine, and also the generation of frictional heat, which has a serious effect on the electrostatic performance of the toner. MICR single-component developers typically contain additives such as titanium dioxide and powder flow enhancement additives such as that known under the tradename "Aerosil," and so frictional heat generated around the roll seal in a development unit can be destructive of the performance of MICR toner. In particular, frictional heat generated in the development unit causes agglomeration, or "clumping," of the MICR toner within the development unit. These agglomerates, should they be trapped between the C/M blade and the donor roll, will create bands of nonuniformly charged toner on the donor roll, leading to non-uniform development of the latent image; also, the trapped agglomerates will cause areas of high wear on the donor roll. It is therefore important to avoid such agglomeration, and a preferred technique for avoiding agglomeration is to prevent frictional heat from concentrating on any given quantity of toner within the development unit.

DESCRIPTION OF THE PRIOR ART

U.S. Pat. No. 5,166,733 discloses a single-component developer unit wherein the housing is generally of a two-piece "clamshell" design. A small blade, disposed between the two pieces of the housing, is urged against the developer roll near the end thereof. The blade has a diagonal surface to guide toner particles on the developer roll back into the housing so they do not leak out of the housing.

SUMMARY OF THE INVENTION

According to the present invention, there is provided an apparatus for applying toner particles to a charge-retentive surface. A housing is provided for retaining toner particles, the housing defining an interior surface. A roll is rotatably mounted relative to the housing, with a first portion of the interior surface of the housing being substantially evenly spaced from a portion of the main surface of the roll. The roll defines a main surface having a length and a circumference, and the roll is disposed to convey toner particles to the charge-retentive surface. A groove is defined in the first portion of the interior surface of the housing, the groove extending along at least one-quarter of the circumference of the roll.

BRIEF DESCRIPTION OF THE DRAWINGS

In the drawings:

FIG. 1 is a sectional elevational view showing the basic elements of a xerographic development unit using single-component magnetic developer material, where the present invention could be implemented;

FIG. 2 is a sectional elevational view, through line 2—2 in FIG. 1, showing the configuration of a donor roll and groove according to the present invention.

DETAILED DESCRIPTION OF THE INVENTION

Figure 3:
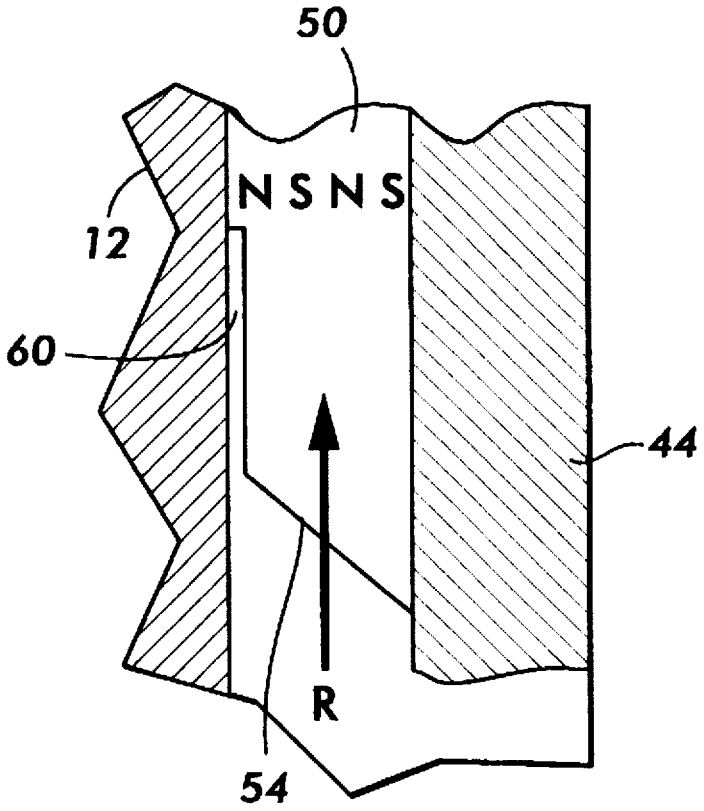
FIG. 3 is a sectional view, through line 3—3 in FIG. 1, showing a feature of a preferred embodiment of the present invention.

FIG. 1 is a sectional elevational view of a development unit that would be used, for example, to apply single-component developer or toner to an electrostatic latent image on a photoreceptor in an electrophotographic printing or copying apparatus. The development unit, generally indicated as 10, includes a housing 12, which retains a quantity of single-component developer or toner, the top level of which is indicated by the dotted line marked 14. The toner in this embodiment is expected to fill substantially the entire housing 12, or at least the toner level should be over the axle of the sleeve 20, which will be described below. As toner is consumed in the course of use of development unit 10, additional toner is typically supplied through an input port (not shown) connected to an external supply of toner.

Disposed within the housing 12 are a pair of augers 16, 18, which have the general function of distributing toner evenly along the length of a donor roll generally indicated as 20, which, as is known in the art, typically extends across a width of a moving, charge-retentive photoreceptor drum or belt, a portion of which is shown as charge receptor 21, which forms an essential part of an electrostatographic printer or copier. The donor roll 20 includes an outer sleeve 22, typically made of phenolic, ceramic, or anodized aluminum, which rotates around a stationary magnetic assembly indicated as 24; in this way the rotation of sleeve 22 causes the conveyance of toner particles from housing 12 to an electrostatic latent image on charge receptor 21. Augers 16 and 18, along with sleeve 22 of donor roll 20, rotate at various speeds, typically through an arrangement of gears or pulleys (not shown) by which they are connected.

Around the "floor" of the interior surface of housing 12, the portion of the interior surface around the bottom of sleeve 22 is reasonably evenly spaced relative to the surface of sleeve 22.

A charge/metering blade, here indicated as metering blade 30, is mounted to be urged against a portion of the sleeve 22 of donor roll 20. The metering blade 30 may also include some type of holder, such as indicated as 32, as well as a silicone pad 34, which directly contacts the sleeve 22 of donor roll 20.

FIG. 2 is another sectional elevational view, through line 2—2 shown in FIG. 1, showing a roll seal disposed toward one end of donor roll 20. As can be seen in FIG. 2, the sleeve 22 of donor roll 20 is mounted on an axle 26 which extends out of the housing 12, and is connected to some external source of mechanical energy (not shown). Disposed around axle 26 at the end of sleeve 22 is what is known as a "tracking roll" 40, which may be permitted to rotate independently on sleeve 22. Tracking roll 40 has a slightly larger radius than sleeve 22, and engages a surface of the photoreceptor, thereby enabling the bulk of the length of sleeve 22 to be evenly spaced from the photoreceptor. Tracking roll 40 is engaged by a foam pad extending most of the circumference therearound, portions of which are shown as 42 in the sectional view of. FIG. 2. According to a preferred embodiment, the foam pads 42 can be covered with a low-friction covering 44.

According to a preferred embodiment of the invention, extending around at least a portion of the circumference of sleeve 22 at the end thereof is a magnetic seal indicated as 50, shown in two parts in the sectional view of the Figure. The magnetic seal 50 defines magnetic poles in distinct locations therein, such as by incorporating permanent magnet material in, for example, a flexible plastic. Each N or S magnetic pole within seal 50 extends around at least a portion of the circumference of sleeve 22, and the poles alternate along the length of sleeve 22. The main surface of magnetic seal 50 is evenly spaced relative to the adjacent surface of sleeve 22.

Further according to a preferred embodiment of the invention, magnetic seal 50 defines a uniform gap relative to the surface of sleeve 22, and this gap, indicated as 52 in the Figure, is preferably between 0.2 and 0.5 millimeters wide. In other words, gap 52 should be of a width from between 10 and 50 , and more preferably between 20 and 50, times the median diameter of the toner particles, given a particular type of developer material; the illustrated embodiment is intended for single-component magnetic developer in which the toner particles are of a median diameter of 10 micrometers.

FIG. 3 is a sectional view through the line marked 3—33 in FIG. 1, showing a feature of a preferred embodiment of the present invention (it will be noted that the cross-section of FIG. 3 generally follows the curvature of sleeve 22). Visible in both FIG. 2 and FIG. 3 is a groove, or channel, 60 which is defined in the interior surface forming the "floor" of housing 12. This channel 60 extends around approximately one-quarter to one-half the circumference of sleeve 22, and preferably is disposed away from a portion of sleeve 22 corresponding to an image-forming area on photoreceptor 21. The overall purpose of channel 60 is to collect toner particles which accumulate around magnetic member 50 in the course of use of the development unit, and cause those collected toner particles to be redistributed around the surface of the rotating sleeve 22. Groove 60 thus forms a "return channel" to relieve a build-up of toner particles which tends to occur at the bottom and end of a rotating donor roll.

Preferred dimensions for the groove 60 are greater than 0.5 millimeters but less than 3 millimeters in depth relative to the floor of the interior surface of housing 12, and also greater than 0.5 millimeters and less than 3 millimeters in width, that is, in the dimension parallel to the length of sleeve 22.

According to a preferred embodiment of the present invention, the effective ends of the groove 60 extend from the very bottom of the sleeve 22 to an area generally around the charge/metering blade 30. In this way, toner particles which collect at the floor of the housing 12 by gravity will be channeled up to an area where the charge/metering blade 30, as shown in FIG. 1, can aid in the redistribution of the returned toner particles.

It is further apparent from FIG. 3 that, in this particular embodiment, the groove 60 is in effect cut out of a portion of magnetic member 50. This is a design convenience if the magnetic member 50 is formed from a separate member which is installed in the housing 12. However, it is conceivable that the groove 60 could be formed directly in the bulk of the material forming the housing 12, such as when the housing 12 is molded out of plastic.

The fact that, in the preferred embodiment, the groove 60 is immediately adjacent the magnetic poles formed in magnetic member 50, makes this embodiment particularly conducive for magnetic-based toners. However, the general principle of providing a groove such as 60 can conceivably be applied to any single-component, and even a two-component, development system, where toner and/or carrier particles may tend to accumulate at the ends of a donor roll. The return channel formed by the groove relieves mechanical pressure formed on the developer material by allowing accumulating material to be redistributed around the donor roll.

At the portion of magnetic member 50 toward the bottom of the donor roll 20, the magnetic member 50 forms a diagonal edge here indicated as 54. As sleeve 22 rotates, relative movement of the sleeve, shown as R in FIG. 3, will cause some toner particles remotely adhering to sleeve 22 to be caught by diagonal edge 54; the direction of diagonal edge 54 relative to rotational direction R is such that toner particles caught in the sleeve are funneled back into the bulk of the housing 12, and generally away from the pad 42 or its covering 44. The diagonal edge 54 thus forms a "funnelling surface" which causes toner particles moving with direction of rotation R to be funnelled into groove 60.

While the invention has been described with reference to the structure disclosed, it is not confined to the details set forth, but is intended to cover such modifications or changes as may come within the scope of the following claims.

I claim:

1. An apparatus for applying toner particles to a charge-retentive surface, comprising:

a housing for retaining toner particles, said housing defining an interior surface;

a roll, defining a main surface having a length and a circumference, the roll being disposed to convey toner particles from the main surface thereof to the charge-retentive surface, the roll being rotatably mounted relative to the housing and a first portion of the interior surface of the housing being substantially evenly spaced from a portion of the main surface of the roll;

a groove defined relative to said first portion of the interior surface of the housing, said groove extending along at least one-quarter of the circumference of the main surface of the roll; and a magnetic member, said magnetic member effectively defining at least one magnetic pole on the interior surface of the housing adjacent the groove.

2. The apparatus of claim 1, said groove being greater than 0.5 millimeters deep.

3. The apparatus of claim 1, said groove being greater than 0.5 millimeters.

4. The apparatus of claim 1, said groove being less than 3 millimeters wide.

5. The apparatus of claim 1, said groove being less than 3 millimeters deep.

6. The apparatus of claim 1, a portion of the groove being disposed adjacent a bottom portion of the roll.

7. The apparatus of claim 1, the interior surface of the housing further defining a funnelling surface adjacent the groove, the funnelling surface being shaped to cause funnelling of toner particles moving with a direction of rotation of the roll into the groove.

8. The apparatus of claim 7, the funnelling surface being disposed generally near a bottom portion of the roll.

9. The apparatus of claim 1, the magnetic member effectively defining a plurality of alternating magnetic poles on the interior surface of the housing, each of said plurality of magnetic poles extending adjacent a portion of the circumference of the roll.

10. The apparatus of claim 1, further comprising a metering blade mounted in the housing and urged against a portion of the roll, the groove defining one end disposed generally at the metering blade.

11. An electrostatographic printing apparatus, comprising:

a charge-retentive surface;

a housing for retaining toner particles, said housing defining an interior surface;

a roll, defining a main surface having a length and a circumference, the roll being disposed to convey toner particles from the main surface thereof to the charge-retentive surface, the roll being rotatably mounted relative to the housing and a first portion of the interior surface of the housing being substantially evenly spaced from a portion of the main surface of the roll;

a groove defined relative to said first portion of the interior surface of the housing, said groove extending along at least one-quarter of the circumference of the main surface of the roll; and a magnetic member, said magnetic member effectively defining at least one magnetic pole on the interior surface of the housing adjacent the groove.

12. The apparatus of claim 11, a portion of the groove being disposed adjacent a bottom portion of the roll.

13. The apparatus of claim 11, the interior surface of the housing further defining a funnelling surface adjacent the groove, the funnelling surface being shaped to cause funnelling of toner particles moving with a direction of rotation of the roll into the groove.

14. The apparatus of claim 13, the funnelling surface being disposed generally near a bottom portion of the roll.

15. The apparatus of claim 11, further comprising a magnetic member, said magnetic member effectively defining at least one magnetic pole on the interior surface of the housing adjacent the groove.

16. The apparatus of claim 15, the magnetic member effectively defining a plurality of alternating magnetic poles on the interior surface of the housing, each of said plurality of magnetic poles extending adjacent a portion of the circumference of the roll.

17. The apparatus of claim 11, further comprising a metering blade mounted in the housing and urged against a portion of the roll, the groove defining one end disposed generally at the metering blade.

* * * * *